United States Patent [19]

Trudell et al.

[11] Patent Number: 4,959,984

[45] Date of Patent: Oct. 2, 1990

[54] PRECISION BENDING APPARATUS

[75] Inventors: Gerald R. Trudell, Pinconning; Terrance C. Marlinga, Kawkawlin, both of Mich.

[73] Assignee: AP Parts Manufacturing Company, Toledo, Ohio

[21] Appl. No.: 395,043

[22] Filed: Aug. 17, 1989

[51] Int. Cl.[5] ..... B21D 7/04

[52] U.S. Cl. ..... 72/20; 72/43; 72/150; 72/154

[58] Field of Search ..... 72/307, 154, 149, 8, 72/21, 20, 33, 43, 150

[56] References Cited

U.S. PATENT DOCUMENTS

| | | | |
|---|---|---|---|
| 2,810,422 | 10/1957 | Bower . | |
| 2,974,706 | 3/1961 | DeWitt | 72/154 |
| 3,205,690 | 9/1965 | Roessler, Jr. . | |
| 3,452,570 | 7/1969 | Steel . | |
| 3,456,482 | 7/1969 | Maier et al. . | |
| 3,553,989 | 1/1971 | Munro et al. . | |
| 3,974,676 | 8/1976 | Eaton | 72/307 |
| 4,063,441 | 12/1977 | Eaton . | |
| 4,078,411 | 3/1978 | Eaton . | |
| 4,126,030 | 12/1978 | Zollweg et al. . | |
| 4,130,004 | 12/1978 | Eaton | 72/154 |
| 4,201,073 | 5/1980 | Eaton . | |
| 4,269,054 | 5/1981 | Eaton . | |
| 4,380,917 | 4/1983 | Uchida et al. . | |
| 4,537,053 | 8/1985 | Schwarze . | |
| 4,625,531 | 12/1986 | Lafrasse et al. . | |
| 4,732,025 | 3/1988 | Marllinga et al. . | |
| 4,744,233 | 5/1988 | Trudell . | |

*Primary Examiner*—Daniel C. Crane

*Attorney, Agent, or Firm*—Anthony J. Casella; Gerald E. Hespos

[57] ABSTRACT

A tube bending apparatus is provided for placing a plurality of bends in an elongated tube. The apparatus includes a position sensor for sensing at least one location on the tube for assessing the accuracy of the bends placed therein. The apparatus further includes a programmable bender having a bend die and a clamp die for securely engaging the tube and bending the tube through a selected degree of curvature. A collet assembly is operative to axially and rotationally position the tube for each sequential bend. A pressure die boost and a collet assembly are provided for exerting axial pressure on the tube to urge the tube into the bend. The amount of axial force is programmed and selectively controllable in response to sensed operating conditions. A lubricated mandrel is programmably operative to be placed inside the tube. The movement of the mandrel is programmable and the flow of lubrication therethrough is both programmable and condition responsive.

11 Claims, 2 Drawing Sheets

PRECISION BENDING APPARATUS

BACKGROUND OF THE INVENTION

Tubes are employed on vehicles to transport exhaust gases generated by the vehicular engine to a location on the vehicle from which the exhaust gases can be emitted safely. The exhaust system is generally relegated to a space that has not previously been committed to other structural and operational components of the vehicle. Additionally, the exhaust system must provide a specified clearance from certain other components of the vehicle, and must be disposed in visually unobtrusive places on passenger cars and many small trucks. In view of these various limitations, the tubular components of exhaust systems invariably must be bent to follow a very circuitous path. Additionally, the circuitous path required for tubular exhaust products will vary substantially from one vehicle model to the next.

The cross sectional area of an exhaust pipe is determined in part by the volume of exhaust gases produced by the engine. Large trucks will generally require exhaust pipes with cross sectional dimensions much greater than the corresponding pipes on passenger cars. Larger diameter pipes are of course much more expensive than smaller diameter pipes and therefore bending errors in large pipes can be very costly. The exhaust pipes of many trucks extend to an elevated position on the vehicle, and therefore are visually apparent. In many instances these exhaust pipes are formed from stainless steel to provide some degree of aesthetic attractiveness. Stainless steel exhaust system components can be significantly more expensive than exhaust components made from other materials. As the number of components and accessories on vehicles increases, the limited space available for exhaust system components diminishes. As a result, the tubular exhaust system components often must be manufactured with great precision to ensure that the exhaust system is retained in the minimal space that has been allotted to it. Even a small angular error in a bend at one end of an exhaust pipe can result in a significant displacement error at the opposed end of the pipe.

Tubular stock material has been used to manufacture other components of vehicles. For example, rectangular tubes recently have been employed to manufacture vehicular frames. Rectangular tubes used for vehicular frames generally do not require the extreme bends required for exhaust pipes. However, the rectangular frame rails must be bent with extreme precision to ensure proper mating with other structural components of the vehicle.

Pipe or tube benders typically comprise at least a bend die, a clamp die and a pressure die. The bend die includes an arcuate surface which defines the inner circumference of each bend formed by the bending apparatus. The clamp die is disposed radially outwardly from the bend die, and is operative to clamp the tube to be bent between the clamp die and the bend die. The pressure die also is disposed at a radially outer position of the tube to be bent, and is initially adjacent to and aligned with the clamp die. The clamp die and the bend die are operative to rotate in unison relative to the pressure die, and to thereby bend the tube. Although the radius of curvature is determined by the physical dimensions of the bend die, the degree of curvature can readily be determined by the amount of rotation of the bend die and clamp die. Most benders also include a wiper die which is disposed in generally opposed relationship to the pressure die and adjacent to the bend die. The wiper die and the pressure die thus define the tangent at the trailing end of each bend. In most vehicular tube bending operations, a mandrel will also be disposed within the tube to ensure that the tube does not deform excessively in response to the bending forces. Additionally, many benders will include a pressure die booster which exerts an axial force on the pressure die to urge the pressure die toward the clamp die during a bending operation. The pressure die booster is intended to push the tube into the bend, thereby reducing the amount of thinning that might otherwise occur on the outer circumferential wall of each bend. After the tube has been bent by the prior art apparatus, at least one end of the bent tube may be presented to a sizer which wedges or otherwise alters the cross section of the tube to mate with another exhaust system component.

Programmable benders have been available for many years. The typical programmable bender includes all of the above described components, and further includes a programmably movable collet which is operative to grip the trailing end of each tube to be bent. The collet is operative to undergo selective rotations and axial movements to properly position the tube for each sequential bend. The rotational movements of the bend die and the clamp die are also programmed. Thus, the collet will axially and rotationally position the tube relative to the bend die, and the bend die and clamp die will cooperate to effect a preprogrammed bend. Upon completion of the bend, the collet will axially and rotationally position the pipe for the next sequential bend.

Even with the above described programmable benders, bending errors are known to exist. For example, in some situations the metallurgical characteristics of a particular tube will cause the tube to spring back after the bending forces have been released. This spring-back will vary from one tube to the next and cannot readily be predicted. In other situations, the momentum caused by movements in the leading end of the tube will generate bending moments in addition to the bending forces generated by the apparatus. A very efficient bending apparatus to control these problems is shown in U.S. Pat. No. 4,732,025 which issued to Gerald R. Trudell and Terrance C. Marlinga on Mar. 22, 1988 and which is assigned to the assignee of the subject application. The apparatus disclosed in U.S. Pat. No. 4,732,025 includes a position sensing device which is operative to sense the location of a leading portion of the tube to determine if the leading portion of the tube is in prespecified positions at various stages of the bending process. The disclosure of U.S. Pat. No. 4,732,025 is incorporated herein by reference.

An apparatus for bending rectangular tubes, such as the rectangular tubes used in the above described vehicular frames is disclosed in U.S. Pat. No. 4,744,233 which issued to Gerald R. Trudell on May 17, 1988 and which also is assigned to the assignee of the subject invention. The apparatus disclosed in U.S. Pat. No. 4,744,233 includes movable components in the pressure die, movable components in the clamp and an improved mandrel, each of which improves efficiency in bending rectangular tubes. The disclosure of U.S. Pat. No. 4,744,233 also is incorporated herein by reference.

Despite the advantages achieved with the above referenced U.S. Pat. No. 4,732,025 and U.S. Pat. No. 4,744,233, it is desired to provide even further improvements in programmable tube benders. For example, it has been found that differences in metallurgical characteristics will cause tubes to respond differently to the forces generated during bending. In particular, it is known that some tubes will fail in response to the forces generated by the bender while others will not. Failures typically will be defined by either a rupture in an outer wall of a bend or a collapsing adjacent an inner wall of a bend. These problems are particularly likely to occur in large diameter tubes where the wall thickness represents a relatively smaller proportion of the total diameter. These problems are also more likely in tubes subjected to one or more bends defining relatively large degrees of curvature. As noted above, large diameter tubes are expensive, particularly those manufactured from stainless steel. A high percentage of failures in such tubes can be extremely costly even if the raw material in the pipe can be salvaged for scrap value. Similarly, even small diameter tubes that fail when subjected to high degrees of curvature represent costly losses. A substantial part of these cost penalties are attributable to the labor and machine time that has been devoted to making the stock material into a tube and at least beginning the bending operations on the tube.

In view of the above, it is an object of the subject invention to provide a tube bender that is operative to create a plurality of precise bends in a tube.

It is another object of the subject invention to provide a tube bender that is operative to substantially minimize failures attributable to bending.

It is an additional object of the subject invention to provide a tube bending apparatus that is operative to sense changes in bending conditions, and alter the operation of the bender to accommodate the sensed changes in bending conditions.

Still a further object of the subject invention is to provide a tubebending apparatus that enables bends of relatively high degrees of curvature to be placed in relatively close proximity to one another with a significantly reduced likelihood of failure.

SUMMARY OF THE INVENTION

The subject invention is directed to a programmable bender for bending elongated metal tubes or pipes such as vehicular exhaust pipes. The subject bender may comprise a bend die, a clamp die, a pressure die and a wiper die all of which are disposed substantially as described above for placing bends of programmably selected magnitudes in the tube.

The programmable bender of the subject invention further comprises a collet which is operative to securely grip the trailing end of the tube and to subject the tube to programmably selected axial and rotational movements. Thus, the collet is operative to axially and rotationally position portions of the tube for each sequential bend that is carried out by the bend die and clamp die. The collet of the subject bending apparatus also is operative to exert an axial force on the end of the tube during each bending operation. Thus, in addition to positioning the tube for each bend, the collet is operative to replace and/or assist the pressure die boost for urging the tube into the bend. The axial force exerted by the collet during each bending operation is generally more effective than axial forces exerted by a pressure die and is effective to substantially prevent or minimize excessive thinning in the portion of the tube wall defining the outer circumference of each bend.

The collet may be axially movable through the interengagement of gears, such as a rack and pinion to avoid the stretching or other damage to cables or chains that are provided on the collets of prior art benders. The power for effecting the movement of the collet may be provided by a hydraulic motor. A plurality of parallel spaced apart drive means for the collet may be provided to ensure efficient balancing of forces exerted by the collet.

The subject invention further comprises sensing mean for sensing the axial pressure resistance encountered by the collet and/or the pressure die boost. The means for sensing the resistance encountered by the pressure die boost and/or the collet is operatively connected to control means of the programmable bender. The control means is responsive to sensed pressures that are outside a specified range of allowable sensed pressures. In particular, an unacceptably high sensed pressure may be indicative of mechanical failure that could precede a major breakdown of the bending apparatus. Conversely, an unacceptably low sensed pressure could indicate an excessive yielding of the tube material that could be indicative of ensuing failure of the bent part. In response these and other sensed conditions, the control means may alter the normal operation of the programmable bending apparatus. In particular, the control means could generate an increase or decrease in the axial force exerted by the pressure die boost or the collet. Alternatively, the control means could alter the rate of bending or could alter the rate of flow of lubricants in the apparatus. In response to certain sensed conditions, the control means will merely terminate the bending operation and generate an appropriate signal that will be responded to by a technician.

The programmable bending apparatus of the subject invention may further include a programmably lubricated mandrel. In particular, a lubrication control system may be operatively connected to the control means for altering the flow of lubricant in response to the degree of curvature and/or in response to certain sensed conditions within the bending apparatus.

At least selected movable components of the bending apparatus may comprise an overarm stabilizer bar to provide stability to the tooling. The stabilizer bar may be in addition to the other interconnections between operative components of the bender.

The bending apparatus of the subject invention further comprises a wiper die to define a tangent location adjacent the inside of the bend. The wiper die is operative to be selectively rotatable relative to the bending die. Thus, for selected bend operations, the wiper die can be rotated away from the bend die and the tube to enable the collet to enter the area between the pressure die and the wiper die. This decreases the offal or the portion of the tube adjacent the end thereof that would normally be wasted.

The bending apparatus further comprises position sensing means which may be similar to the position sensing means described in the above referenced prior art. The position sensing means may be operatively connected to the control means. The control means may further be operative to coordinate the pressure die boost forces and the axial forces exerted by the collet with the data received from the position sensing means. In this manner, as the actual sensed tube configuration begins to approach the limits of a specified range, the control means can self compensate to adjust programmable aspects of the apparatus.

The control means may further comprise printing means or other display producing means to track the performance of the bending apparatus. In this manner, the control means will be operative to identify the need for repairs in the bending apparatus as the apparatus begins to approach the limits of specified performance levels.

DETAILED DESCRIPTION OF THE PREFERRED EMBODIMENT

Figure 1:
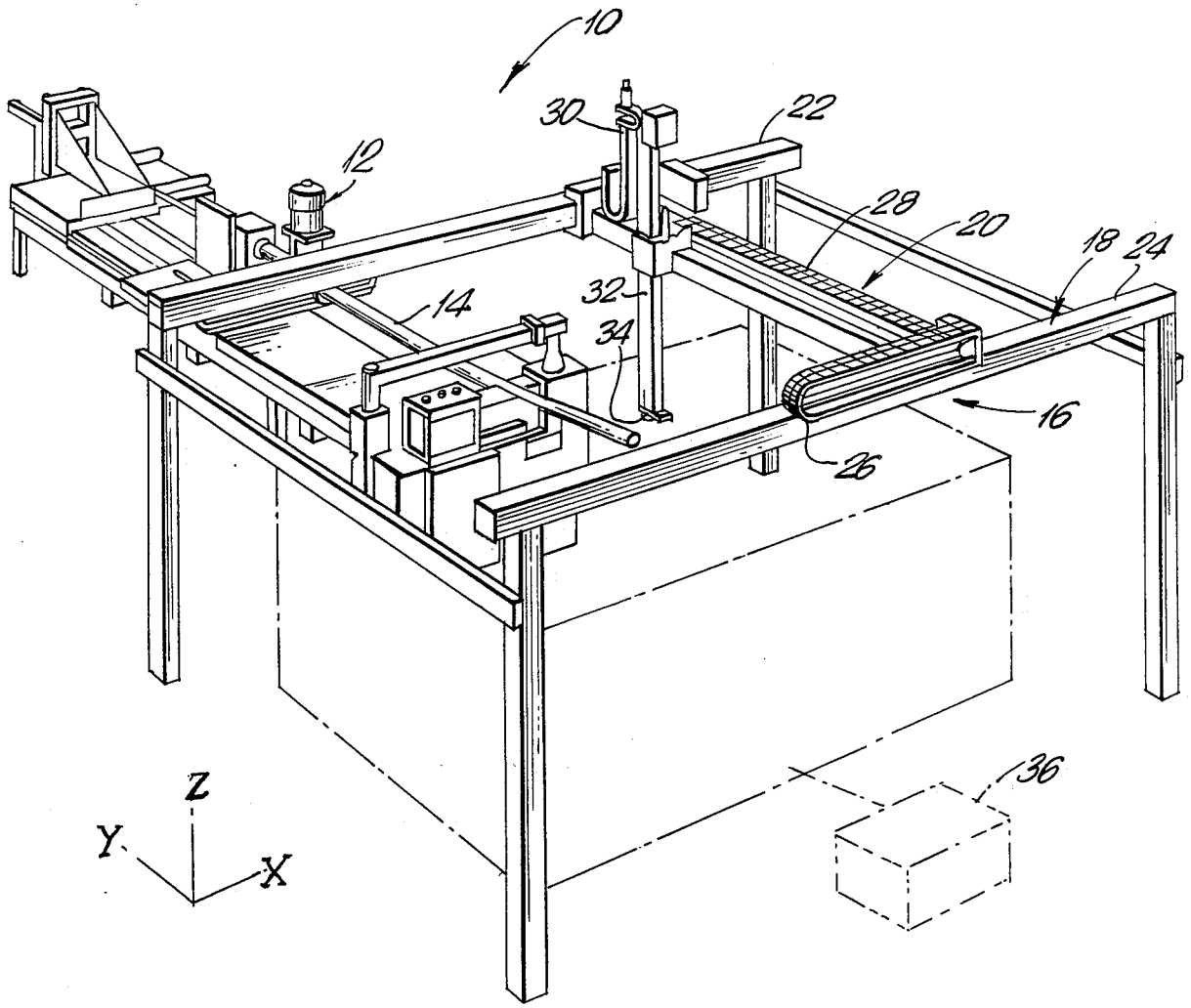
FIG. 1 is a perspective view of a bending apparatus in accordance with the subject invention.

The bending apparatus of the subject invention is identified generally by the numeral 10 in FIG. 1. The bending apparatus 10 includes a programmable bender 12 which is operative to place a selected array of precise bends in a tube 14. As used herein, the term tube is intended to include all elongated tubular members, including exhaust pipes and tubular members of non-circular cross section.

The bending apparatus 10 further comprises a position sensing apparatus which is identified generally by the numeral 16. The position sensing apparatus 16 includes a gantry 18 along which a programmable robotic probe assembly 20 is movable. In particular, the gantry support 18 includes a pair of parallel X-axis supports 22 and 24 which are disposed in spaced parallel relationship and generally above the programmable bender 12. The robotic apparatus 20 includes a track drive 26 which permits movement of the entire programmable robotic apparatus 20 parallel to the X axis. The robotic apparatus further includes a track support 28 extending parallel to the Y axis and between the X axis supports 22 and 24. A programmable robotic position sensor 30 is movable parallel to the Y axis and along the track 28. The robotic position sensor 30 further includes a position sensing arm 32 which is movable parallel to the Z axis. The probe end 34 of the arm 32 defines position sensing means which is operative to sense the position of a selected location on the tube 14. The general operation of the position sensing apparatus may be similar to that described in the above referenced U.S. Pat. No. 4,732,025, the disclosure of which has been incorporated herein by reference.

The bending apparatus 10 further includes a control unit which is illustrated schematically in FIG. 1 and identified generally by the numeral 36. The control unit 36 is operatively connected to both the programmable bender 12 and the position sensor 16. The control unit 36 is operative to receive and store input data defining various arrays of bends required for different tubes 14 to be bent by the bending apparatus 10. This input data may include data as to the specified ranges of positions to be sensed by the position sensing apparatus 16. The control unit 36 preferably also is operative to receive sensed data from the programmable bender 10 and from the position sensor 16 and to generate appropriate responsive signals as explained further herein. In particular, the responsive signals generated by the control unit 36 may merely be alarms to alert technicians working with the apparatus 10 that an error condition exists or is approaching. Alternatively, the control unit 36 may be operative to generate responsive signals that will appropriately alter the operation of the programmable bender 12 to avoid anticipated error conditions.

Figure 2:
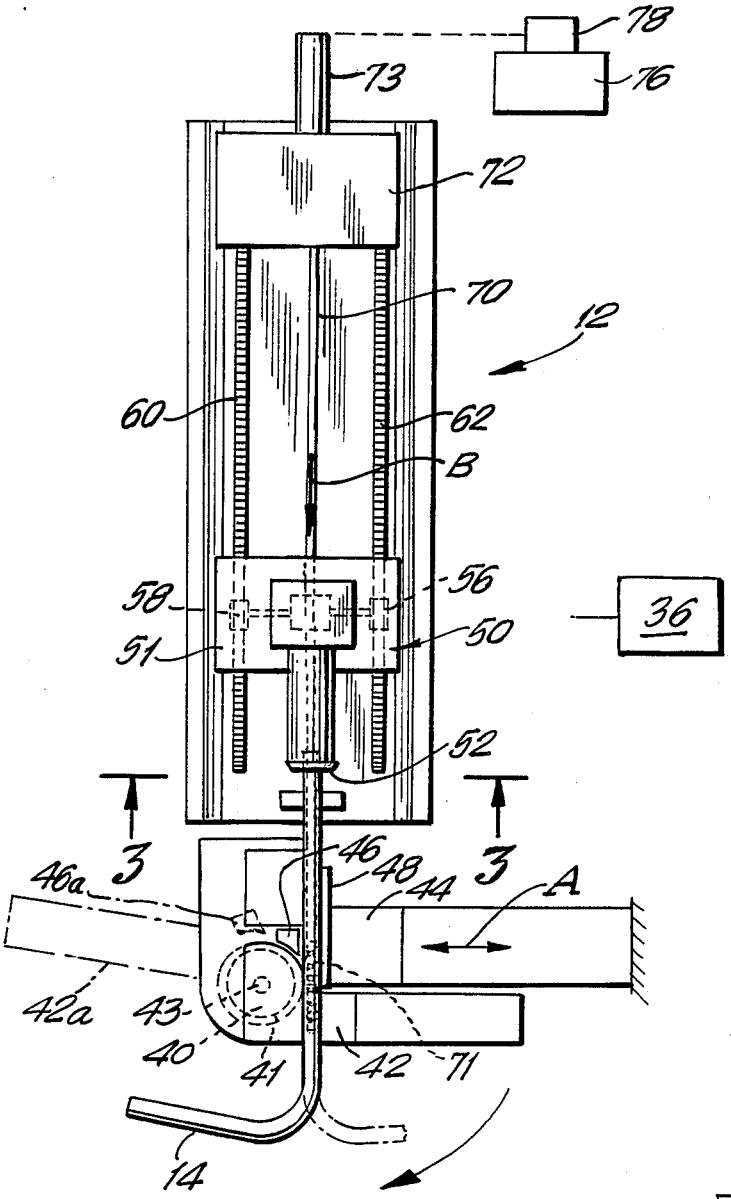
FIG. 2 is a top plan view of a bending apparatus in accordance with the subject invention.
Figure 3:
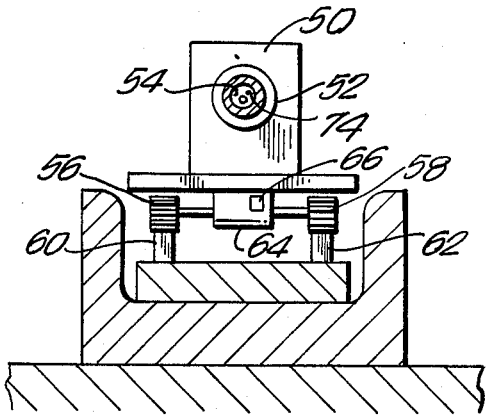
FIG. 3 is a cross sectional view taken along line 3—3 in FIG. 2.

The programmable bender 12 is illustrated in greater detail in FIGS. 2 and 3. More particularly, the programmable bender 12 includes a bend die 40 that is removably mountable thereon and includes at least one tube receiving cavity 41 against which a selected portion of the tube 14 may be clamped. The tube receiving cavity of the bend die 40 is of arcuate plan view configuration, as shown in FIG. 2, to define the radius of curvature for the bends to be placed in the tube 14. The tube receiving cavities 41 of bend dies 40 that may be mounted to the programmable bender 12 preferably permit tubes 14 having diameters that may range from approximately 3 inches to at least approximately 9 inches. The respective radii of curvatures permitted by the various bend dies 40 that may be incorporated into the programmable bender 12 will vary from approximately 4 inches for the smaller diameter tubes to approximately 18 inches for the larger diameter tubes.

The programmable bender 12 further includes a clamp die 42 which is disposed radially outwardly of the bending die 40. The clamp die 42 further is replaceably mounted to the bender 12 such that the selected clamp die 42 corresponds to the diameter of the tube 14 being bent. The clamp die 42 is movable in a radial direction to effect the secure clamping of the tube 14 between the clamp die 42 and the bend die 40.

The bend die 40 and the clamp die 42 are rotatable in unison about a common rotational axis 43 which extends parallel to the Z axis shown in FIG. 1. The maximum rotation of the bend die 40 and the clamp die 42 preferably equals approximately 190°, with the clamp die **42*a* being illustrated in phantom lines in FIG. 2** to identify the extreme ranges of bending movement.

The programmable bender 12 further includes a pressure die 44 which is operative to clamp the tube 14 at the trailing end of each bend to define the tangent portion at the trailing end of the bend. In particular, the pressure die 44 is selectively movable toward or away from the tube 14 as indicated by arrow A in FIG. 2. This movement of the pressure die 44 is operative to securely retain portions of the tube at the trailing end of each bend placed therein.

The pressure die 44 is operative to hold the trailing end of each bend in the tube 14 against a wiper die 46. The wiper die 46 also will define a tangent at the trailing end of each bend, but is disposed on the radially inner side of each bend and generally opposed to the pressure die 44. The wiper die 46 is pivotable relative to the programmable bender 12 to be effectively swung out of the way as the extreme trailing end of the tube 14 approaches the bending die 40. This swing-away position of the wiper die 46, as illustrated in phantom lines in FIG. 2 and as identified by the numeral **46*a*, substantially minimizes wastage or offal at the trailing end of the tube 14**.

The bending of the tube 14 necessarily creates a stretching or thinning of the outer circumferential wall of each bend produced in the tube 14. The programmable bender 12 includes several cooperating elements for controlling the thinning in the outer circumferential wall of the bent tube 14 and for specifically eliminating excessive thinning therein. One such element for controlling the thinning in the outer circumferential wall of the tube 14 is a pressure die boost 48 which is engaged with the pressure die 44 and is operative to urge the pressure die in a tangential direction toward the bend. This tangential movement of the pressure die 44 generated by the pressure die boost 48, when combined with the radially inward forces exerted by the pressure die 44 effectively urges the tube 14 into the bend for preventing excessive thinning in the outer circumferential wall at each bend.

As noted above, each tube 14 will have a plurality of bends of varying degrees of curvature at spaced apart locations therealong. The spacing between each bend will vary from one tube specification to the next. Additionally, the bends will be generated in different radial directions from the original longitudinal center line of the tube. To achieve these different bends, the programmable bender 12 includes a collet carriage assembly identified generally by the numeral 50 in FIGS. 2 and 3. The collet carriage assembly 50 includes a carriage 51 having a collet 52 which is operative to securely grip the trailing axial end of the tube 14. Additionally, the collet 52 is operative to perform selected sizing operations on the trailing end of the tube 14 to enable the tube 14 to be properly mated to another element on an exhaust system. As noted previously, in the prior art, any such sizing operations would necessarily be carried out by an entirely different apparatus. The sizing capabilities of the collet 52 enable the collet 52 to selectively decrease the diameter of the tube 14 at the trailing end. To achieve this sizing function, the collet 52 comprises an array of radially contractable fingers 54, as shown in FIG. 3, which engage the outer circumferential surface of the tube 14 and which are hydraulically powered to be urged radially inwardly for reducing the diameter of the tube 14 at the trailing end.

The collet carriage assembly 50 also is operative to selectively rotate the tube 14 about its longitudinal axis controlled and programmed amounts to position the tube 14 rotationally for the next sequential bend to be placed therein. The collet carriage assembly 50 also is operative to move the tube in axial directions programmed amounts for properly positioning the tube 14 for its next sequential bend. The axial movement of the collet carriage assembly 50 is achieved by pinion gears 56 and 58 which are mounted to the carriage 51 and are rotatable under the forces of a hydraulic motor. The pinion gears 56 and 58 are engaged with gear racks 60 and 62 respectively which are parallel to one another and extend in the axial direction of the unbent tube 14. Thus, rotation of the pinion gears 56 and 58 under the action of a hydraulic motor 64 will cause the entire collet carriage 50 to move in the axial direction as indicated by arrow "B".

The collet carriage assembly 50 is operative to exert axial forces on the trailing end of the tube 14 during a bending operation. More particularly, after the clamp die 42 and pressure die 44 have securely gripped the tube 14 adjacent the bend die 40 the hydraulic motor 64 will urge the collet 52 forwardly relative to the gear racks 60 and 62, and toward the bend die 40 and the clamp die 42. This continued driving force exerted by the collet 52 effectively helps the pressure die boost 48 to urge the trailing end of the tube 14 into the bend, and thereby to avoid excessive thinning in the outer circumferential wall of the bend. In the preferred embodiment, the pressure die boost 48 is operative to exert approximately 2,500 pounds force in a tangential direction, while the collet carriage assembly 50 is operative to generate an additional linear force of up to approximately 9,000 pounds in a generally tangential direction. The magnitude of force generated by either the pressure die boost 48 or the collet carriage assembly 50 is variable and may be preprogrammed through the control unit 36 and/or responsive to sensed conditions as explained herein. Preferably the force exerted by the pressure die boost 48 and the collet carriage assembly 50 can be programmed to decrease after approximately the first 5° of a bend.

The collet carriage assembly 50 further comprises pressure sensing means 66 incorporated into the hydraulic motor 64. The pressure sensing means 66 may comprise a transducer which is operative to sense the resistance encountered by the collet carriage assembly 50 in response to the axial forces exerted by both the collet carriage assembly 50 and the pressure die boost 48. For example, a significant decrease in the sensed pressure may be indicative of an abrupt yielding and thinning of the metal material in the wall of the tube 14 that may immediately precede a failure. The pressure sensor 66 is operatively connected to the control unit 36 such that the sensed data of the pressure sensor 66 is received by the control unit 36 and compared to preestablished standards which may be part of the input data entered into the control unit 36. The control unit 36 may then generate appropriate condition responsive signals which will be dependent upon the particular sensed condition and the original input data defining various characteristics about the tube 14 being bent. The ranges of responses can include an immediate termination of the bending process with a corresponding generation of a signal for the technician operating the bender 12. In other situations, the control unit 36 will alter the operation of the programmable bender 12 in response to the sensed condition. The ranges of alteration may include variation of the forces exerted by the pressure die boost 48 and by the collet carriage assembly 50, or variations to the bending speed.

The operative connections between the control unit 36, the bender 12 and the position sensor 16 may further be employed to alter the forces exerted by the collet carriage assembly 50 and the pressure die boost 48 in response to data sensed by the position sensor 16. Thus, greater or lesser axial forces may be generated by the collet carriage assembly 50 i response to selected sensed position data to ensure that the bent tube 14 will not gradually move out of the specified configuration.

The bending apparatus 12 further comprises a mandrel rod 70 which extends from a mandrel rod carriage 72, through the collet 52 and into the tube 14 being bent. The end of the mandrel rod 70 is fastened to a mandrel assembly 71 which is flexible to bend with the tube. More particularly, the mandrel assembly 71 is disposed substantially at the portion of the tube 14 being bent to prevent an inward collapsing of the tube 14 in response to the bending forces. The mandrel rod 70 includes channels 74 which are in communication with a source of lubricant 76 and a hydraulic pump 78 for urging lubricant into the area between the mandrel assembly 71 and the tube 14. The hydraulic pump 78 for directing lubricant toward the mandrel rod 70 is operatively connected to the control unit 36. Thus, the rate of flow of lubricant through the mandrel rod 70 can be controlled by the control means 36. The parameters affecting the rate of flow of the lubricant may include the initially programmed bend characteristics, including the degree of curvature for the respective bends. Additionally, the flow of lubricant can be condition responsive. Thus, specific conditions sensed by the pressure sensing means 66 of the collet carriage assembly 50 may be detected by the control means 36, which in turn will alter the flow of lubricant through the mandrel 70.

In operation, the programmable bender 12 is employed by first loading the tube 14 over the mandrel assembly 71, the mandrel rod 70, and into the collet 52. This initial loading may either be manual or by robotic means. The collet 52 will then lock onto the tube 14 with sufficient force to achieve the sizing of the end of the tube 14 if required for use of the tube 14 on an exhaust system. The carriage 51 will then move along the racks 60 and 62 position the tube 14 axially at the first bend start position and transversely in the correct cavity 41 of the bend die 40. The clamp die 42 and the pressure die 44 then close to contact the tube 14. The mandrel rod 70 is then extended by the mandrel rod carriage 72 to the bend position and the control unit 36 initiates the flow of lubricant therethrough. The clamp die 42 and the bend die 40 then rotate a selected amount to place the first bend in the tube 14. Simultaneously, the pressure die boost 48 and the collet carriage assembly 50 are urged axially forward to push the tube 14 into the bend. These axial assist forces can be altered at selected points during the bending process in response to signals received by the control unit 36 by the sensor 66. At the completion of the bend, the flow of lubricant through the mandrel rod 70 is ceased and the mandrel carriage 72 is retracted to the tube feed position. The clamp die 42 and the pressure die 44 are then opened. The clamp die 42 is withdrawn and the pressure die 44 moves back to its initial position. The mandrel extractor cylinder 73 can withdraw and the collet carriage 51 can move forward to locate the tube 14 axially in position for the next bend and to locate the mandrel 71 correctly within the tube. When the bent tube 14 has moved axially forward and is clear of the bend die 40, the collet carriage 50 and the mandrel carriage 72 move sideways so that the tube 14 clears the cavity 41 of the bend die 40 and the tooling of the wiper die 46. The collet 52 then rotates the tube 14 to the next plane of bend as dictated by the control unit 36. The bend die 40 then rotates back to its initial position and the above described bending process repeats. As the trailing end of the tube 14 is approached, the collet 52 may be required to be disposed in the space normally occupied by the wiper die 46. In this situation, the wiper die 46 will be swung away to permit further advancement of the collet carriage assembly 50.

While the invention has been described with respect to a preferred embodiment, it is apparent that various changes can be made without departing from the scope of the invention as defined by the appended claims.

We claim:

1. A tube bending apparatus for placing at least one bend in a tube, said apparatus comprising:

collet means for securely gripping one end of the tube and for positioning the tube for selective placement of the bend therein;

non-rotatable clamping means for securely gripping the tube at a location adjacent the selected position for said bend;

rotatable clamping means for clamping the tube at the selected position thereon for the bend and for rotating with the tube clamped therein to place the selected bend in the tube;

first axial pressure means operatively connected to the non-rotatable clamping means for exerting a selected axial pressure on the tube for urging the tube toward the rotatable clamping means; and second axial pressure means operatively connected to the collet means for placing axial pressure on the end of the tube engaged by the collet for urging the tube toward the rotatable clamping means, whereby the first and second axial pressure means are operative to urge the tube into the bend and thereby minimizing potential failure of the tube adjacent the bend therein.

2. A bending apparatus as in claim 1 further comprising control means operatively connected to said first and second axial pressure means for varying the amount of axial pressure in accordance with pre-established parameters.

3. A bending apparatus as in claim 2 wherein the control means is operative to decrease the pressure exerted by the first and second axial pressure means after approximately 5° of rotational movement by the rotatable clamping means.

4. A bending apparatus as in claim 2 further comprising pressure sensing means operatively connected to at least one of said first and second axial pressure means for sensing resistance to said axial pressure, said pressure sensing means being operatively connected to said control means, said control means being operative to alter the axial pressure in response to the sensed resistance to the axial pressure.

5. A bending apparatus as in claim 1 further comprising a mandrel selectively movable into the tube for supporting the tube adjacent the bend, said mandrel comprising means for supplying lubricant to the position of the bend, the means for supplying lubricant being operatively connected to the control means such that the flow of lubricant occurs only during the rotational movement of the rotatable clamp means.

6. A bending apparatus as in claim 1 wherein the collet comprises means for axially and rotationally moving the tube relative to the rotatable clamping means, such that said bending apparatus is operative to place a plurality of bends in the tube.

7. A bending apparatus as in claim 1 further comprising position sensing means movably disposed in proximity to the rotatable clamping means for sensing the position of at least one location on the tube after the completion of a bend therein, said position sensing means being operative to assess the conformance of the bending apparatus to a specified bend configuration.

8. A bending apparatus as in claim 1 further comprising a mandrel and mandrel rod selectively placeable in the tube, said mandrel and mandrel rod comprising channel means for permitting a flow of lubricant therethrough, said bending apparatus further comprising a source of lubricant in communication with the mandrel, said source of lubricant comprising variable flow means for altering the rate of flow of lubricant from the source of lubricant to the mandrel in response to pre-established parameters.

9. A tube bending apparatus for placing a plurality of bends in a tube, said apparatus comprising:

collet means for securely gripping one end of the tube and for axially and rotationally positioning the tube for selective placement of the bends therein, said collet means further being operative to exert an axial force on the gripped end of the tube while the bending apparatus is placing at least a portion of each said bend therein;

non-rotatable clamping means for securely gripping the tube at a location adjacent the selected position for said bend, said non-rotatable clamping means further being operative to exert axial forces on said tube during the placement of at least a portion of each bend in the tube by the bending apparatus;

rotatable clamping means for clamping the tube at the selected positions thereon for said bends, and for rotating with the tube clamped therein to place the selected bends in the tube;

pressure sensing means for sensing the resistance to the axial forces exerted by at least the collet means on the tube;

control means operatively connected to the pressure sensing means and to the rotatable clamping means, said control means being operative to alter the operation of the rotatable clamping means in response to the pressure sensed by said pressure sensing means and to decrease the pressure exerted by the collet means and by the non-rotatable clamping means after approximately 5° of rotational movement by the rotatable clamping means.

10. A tube bending apparatus as in claim 9 further comprising position sensing means for sensing the position of at least one location on said tube after each bend in said tube, said position sensing means being operatively connected to said control means for altering the rotatable movement of the rotatable clamping means.

11. A tube bending apparatus as in claim 9 further comprising a mandrel selectively placeable within the tube, said mandrel comprising at least one channel for delivering a lubricant to the selected positions for each said bend in said tube, said bending apparatus further comprising a supply of lubricant in communication with the mandrel, said supply of lubricant further comprising flow control means operatively connected to the control means of the bending apparatus for selectively altering the flow of lubricant in response to selected parameters.

* * * * *